US006608601B1

(12) United States Patent
Collinson et al.

(10) Patent No.: US 6,608,601 B1
(45) Date of Patent: Aug. 19, 2003

(54) INTEGRATED ANTENNA RADAR SYSTEM FOR MOBILE AND TRANSPORTABLE AIR DEFENSE

(75) Inventors: Donald L. Collinson, Manlius, NY (US); John A. Rougas, Liverpool, NY (US)

(73) Assignee: Lockheed Martin Corporation

( * ) Notice: Subject to any disclaimer, the term of this patent is extended or adjusted under 35 U.S.C. 154(b) by 0 days.

(21) Appl. No.: 09/742,925

(22) Filed: Dec. 21, 2000

Related U.S. Application Data

(60) Provisional application No. 60/172,966, filed on Dec. 21, 1999.

(51) Int. Cl.[7] ..... H01Q 21/08

(52) U.S. Cl. ..... 343/824; 343/793; 342/59

(58) Field of Search ..... 343/729, 730, 343/793, 794, 824; 342/32, 59

(56) References Cited

U.S. PATENT DOCUMENTS

| | | | | | |
|---|---|---|---|---|---|
| 3,845,490 | A | | 10/1974 | Manwarren et al. | 343/821 |
| 3,858,206 | A | * | 12/1974 | Scheidler et al. | 343/7 A |
| 4,468,670 | A | * | 8/1984 | Suzuki et al. | 343/727 |
| 4,800,393 | A | | 1/1989 | Edward et al. | 343/821 |
| 4,825,220 | A | | 4/1989 | Edward et al. | 343/795 |
| 5,311,187 | A | * | 5/1994 | Garside | 342/59 |
| 5,920,277 | A | * | 7/1999 | Foster et al. | 342/32 |
| 6,023,243 | A | | 2/2000 | Frank | 343/700 |
| 6,127,985 | A | | 10/2000 | Guler | 343/771 |

* cited by examiner

*Primary Examiner*—Don Wong
*Assistant Examiner*—Shih-Chao Chen
(74) *Attorney, Agent, or Firm*—Duane Morris LLP

(57) ABSTRACT

Linear or planar arrays of vertically polarized dipole or monopole radiators for an IFF/SSR antenna are interleaved with existing linear arrays comprising a PSR antenna and fed by stripline corporate feed structures which provide the Sum and Side Lobe Suppression (SLS) Channels for IFF/SSR operations, thereby providing two antenna functions within a single antenna aperture area.

15 Claims, 9 Drawing Sheets

INTEGRATED ANTENNA RADAR SYSTEM FOR MOBILE AND TRANSPORTABLE AIR DEFENSE

RELATED APPLICATION

This application claims priority of U.S. Patent application No. 60/172,966, entitled INTEGRATED IDENTIFICATION FRIEND OR FOE (IFF) ANTENNA FOR MOBILE AND TRANSPORTABLE AIR DEFENSE, filed Dec. 21, 1999, the entire disclosure of which is hereby incorporated by reference.

FIELD OF THE INVENTION

The present invention relates generally to radar systems, and particularly to dipole or monopole antennas useful as radiating elements for radar arrays.

BACKGROUND OF THE INVENTION

It is known that antenna applications such as Integrated Friend or Foe (IFF) or Secondary Surveillance Radar (SSR) systems have been implemented with long range Primary Surveillance Radars (PSR). Such systems include the AN/TPS-59(V3), AN/TPS-59(M34), AN/FPS-117 and TPS-117 radar systems, for example.

Such radar systems use a separate linear or planar array of radiators as an IFF or SSR antenna. The IFF or SSR antenna is typically physically bolted to the upper surface of the PSR antenna structure. This can be seen in FIGS. 1A, 1B and 1C, which illustrate Prior Art SSR antenna arrangements 150 bolted to the upper surface of a PSR antenna structure 100. FIG. 1A illustrates an exemplary SSR/PSR arrangement for the AN/TPS-59 system manufactured by Lockheed Martin Corporation. FIG. 1B depicts an exemplary embodiment of TPS-117 Tactical Transportable Radar System, while FIG. 1C shows a transportable model of the FPS-117 Long Range Solid State Radar System. In the case of the AN/TPS-59 and TPS-117 radars, the IFF or SSR antenna is a linear array of dipoles, cavity backed dipoles, or patches which must be physically removed from the PSR in order to relocate or transport the system. The time required to remove or replace the IFF or SSR antenna and the space required to stow it add significant problems to march order configuration, deployment time and transportation requirements, for example.

In the case of the FPS-117 radar system, many of the SSR antennas are large planar arrays which require a separate supporting structure. Such support structures may weigh up to 700 pounds (lbs)., and add over 5 feet (ft) to the overall height of the system. FPS-117 radars with large planar arrays, for example, require much larger radomes (if used) than those with linear arrays. This, too, adds to the overall size and cost of the system.

Integrated IFF antennas also exist in other Tactical Planar Array Radars (TPLARs), such as the AN/PPQ-2 PSTAR Radar. However, in the case of the AN/PPQ-2 system, the IFF antenna is a separate linear array of vertically polarized dipoles situated inside the radome case above the PSR array, thus also adding to the overall size of the system.

SUMMARY OF THE INVENTION

It is an object of the present invention to utilize a linear or planar array of vertically polarized dipole or monopole radiators for an IFF/SSR antenna. The array of radiators is fed by stripline corporate feed or row feed structures which provide the Sum and Side Lobe Suppression (SLS) Channels required for SSR operations. The linear arrays of vertical radiators are interleaved with the existing linear arrays which comprise the PSR antenna, thereby providing two antenna functions within a single antenna aperture. In a primary antenna system comprising a plurality of planar arrays of radiating elements, each planar array separated via a conductive septum, a method of forming an integrated antenna system, the method comprising interleaving portions of a secondary antenna between said plurality of planar arrays by replacing at least a portion of each the conductive septum with a stripline corporate feed using vertically polarized dipoles or monopoles defining a secondary antenna.

In folded, integrated antenna system for use on a vehicle comprising a primary radar comprising a plurality of planar arrays of radiating elements, each planar array comprising a central portion and adjacent wing portions, pivotably coupled to the central portion to fold inward and outward over said central portion and a secondary radar comprising a plurality of planar arrays of vertical radiators interleaved with the plurality of planar arrays of radiating elements and coupled via a stripline feed structure for receiving signal information, and a conductive wing portion substantially aligned with a corresponding one of the adjacent wing portions of the planar arrays and operatively coupled thereto, the conductive wing portion having a plurality of slots therein, each of the slots aligned with a corresponding one of the vertical radiators of the secondary radar to permit folding of the wing portions of the array and the associated conductive wing portion without interfering with the vertical radiators.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not necessarily to scale.

DETAILED DESCRIPTION OF THE INVENTION

Figure 1A:
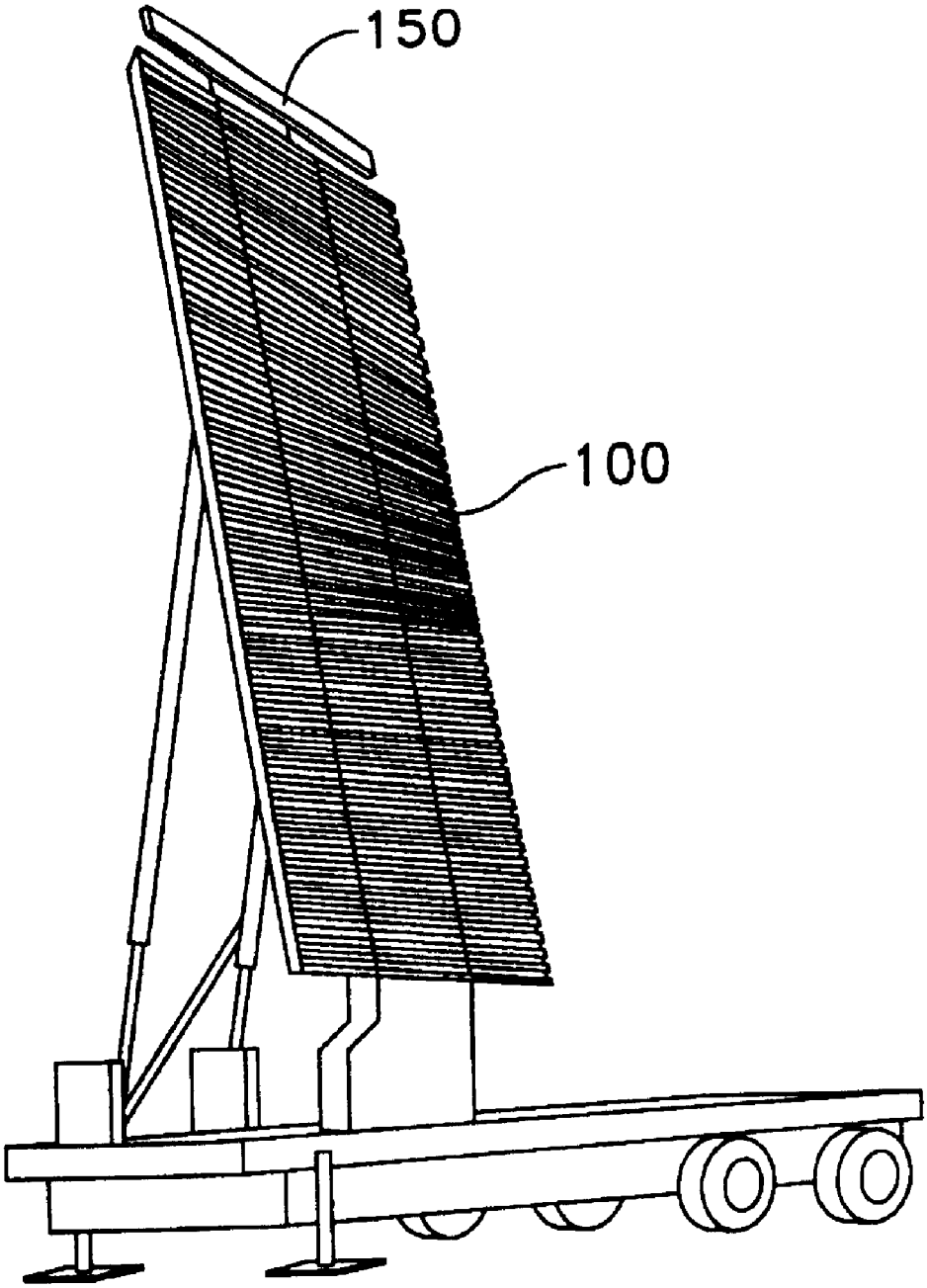
FIG. 1A (PRIOR ART)
FIG. 1A is a schematic illustration of a prior art SSR antenna arrangement bolted to the upper surface of a PSR antenna structure.
Figure 1B:
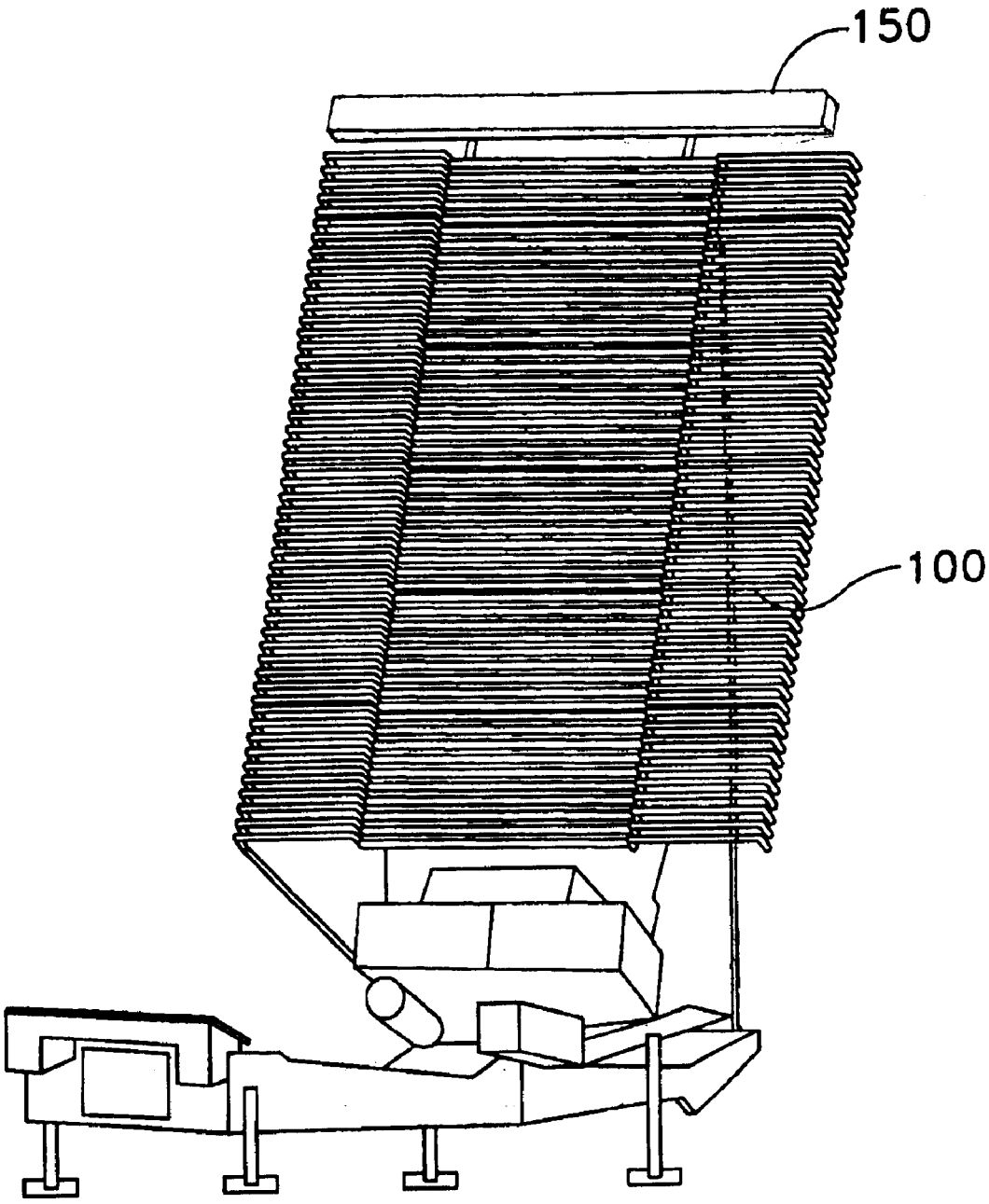
FIG. 1B (PRIOR ART)
FIG. 1B is a schematic illustration of another prior art SSR antenna arrangement bolted to the upper surface of a PSR antenna structure.
Figure 1C:
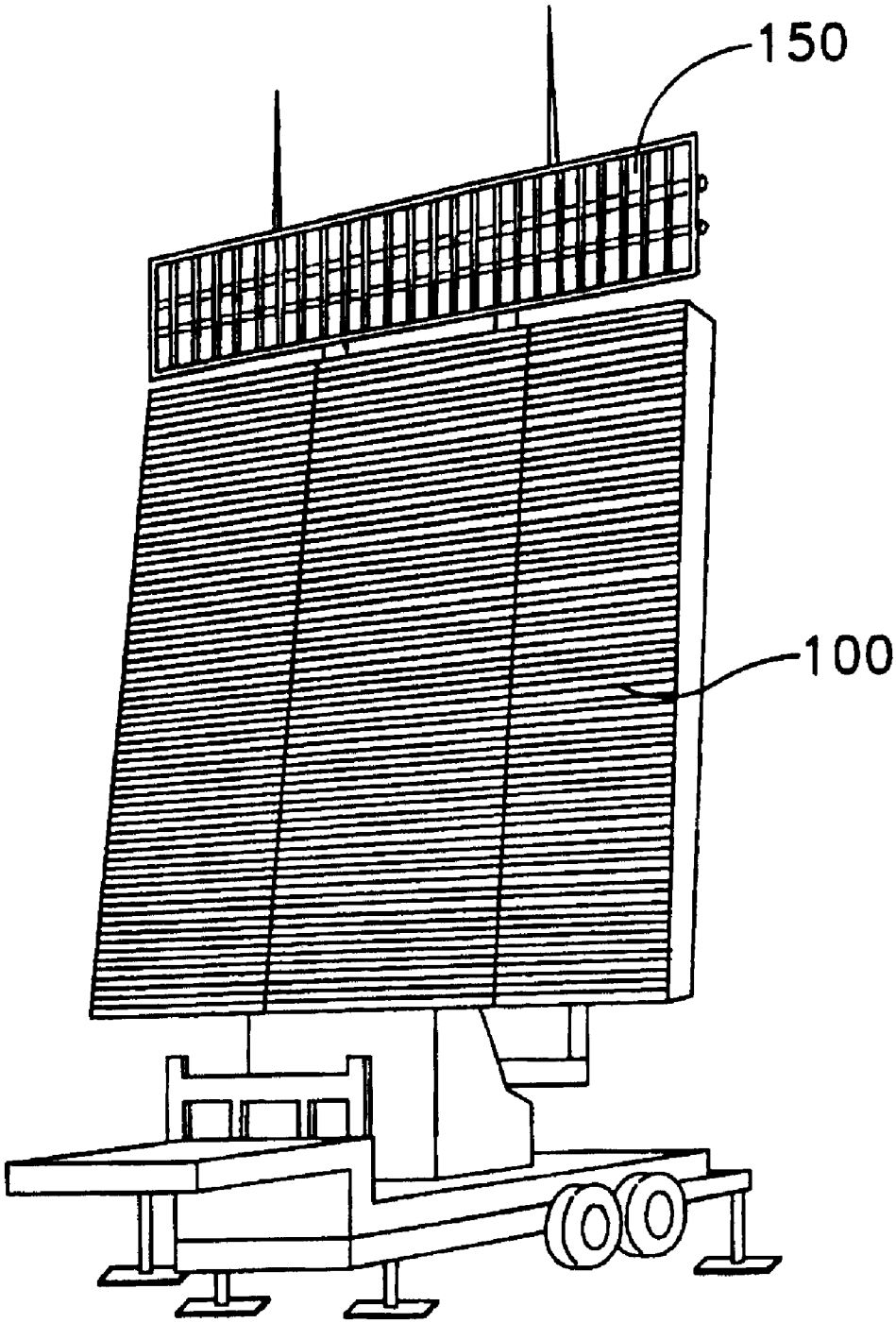
FIG. 1C (PRIOR ART)
FIG. 1C is a schematic illustration of still another prior art SSR antenna arrangement bolted to the upper surface of a PSR antenna structure.
Figure 1D:
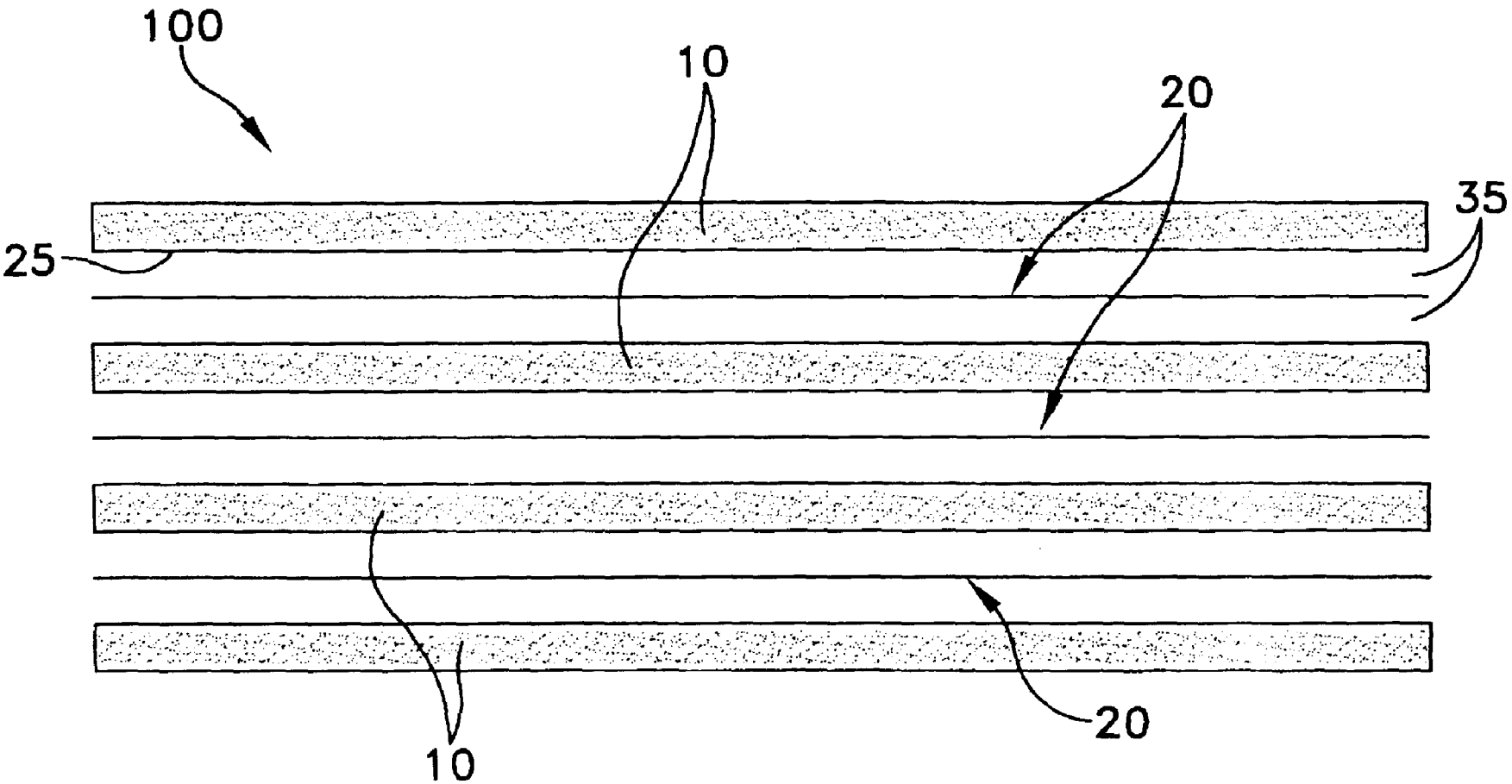
FIG. 1D (PRIOR ART)
FIG. 1D is a schematic illustration of a prior art PSR linear array antenna structure having separated septums.
Figure 1E:
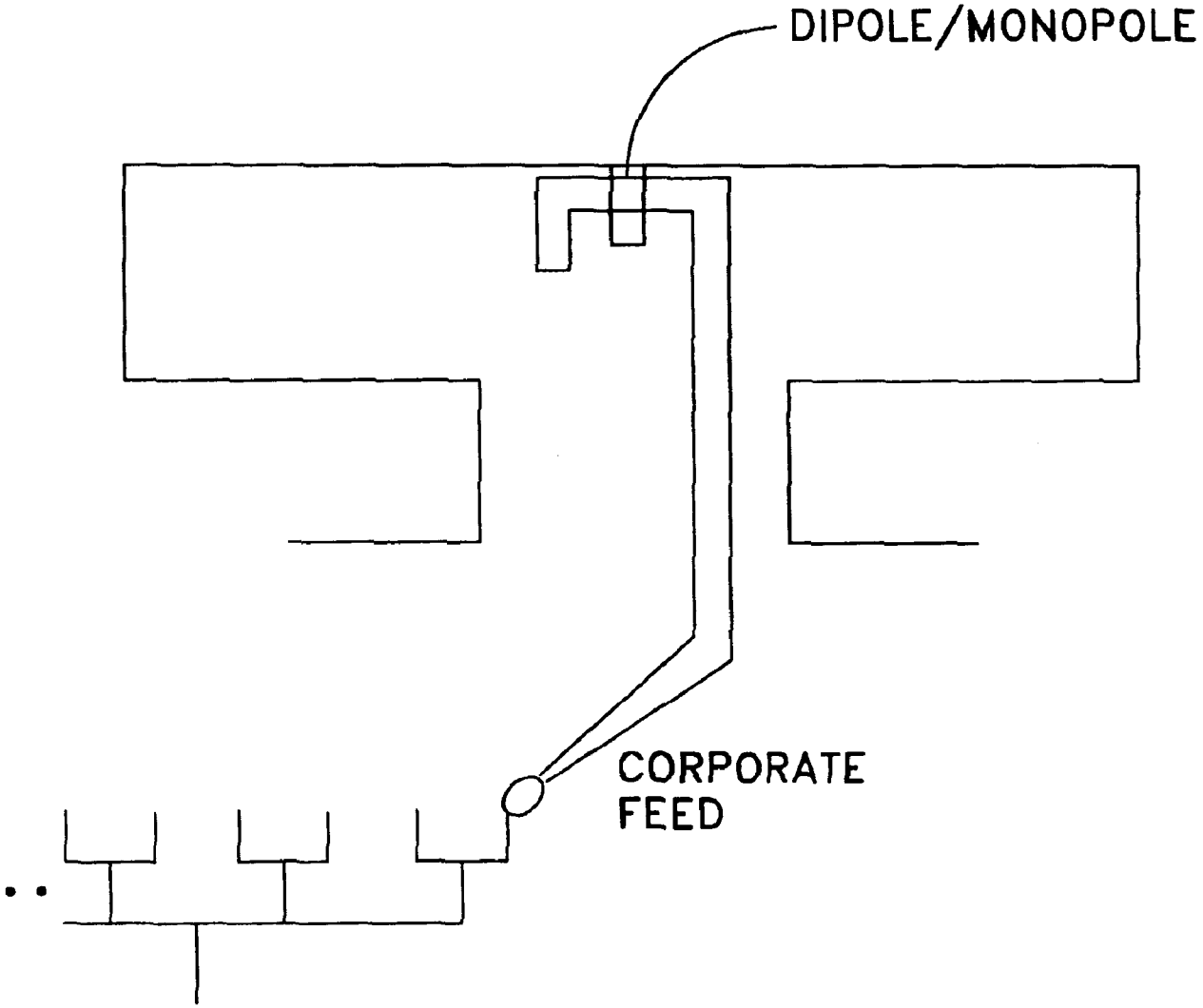
FIG. 1E provides a plan view schematic illustration of a dipole within a PSR linear array attached to a corporate feed structure for cascading the dipoles together to obtain a signal at a given output port.

Present AN/TPS-59, FPS-117 and TPS-117 radar antennas are constructed from linear arrays of horizontal dipole radiators integrated into a stripline corporate feed structure which distributes power to them. It is understood that a stripline is a form of a transmission line having a center conductor and an upper and lower ground plane. In the leading or forward edge of the ground plane, each of the dipoles are disposed or stamped into the metal skin thereof and then fed via the circuit and element feed so as to be coupled to one another using a corporate feed, as is known in the art. FIG. 1E provides a plan view schematic illustration of a dipole within a PSR linear array 10 attached to a corporate feed structure for cascading the dipoles together to obtain a signal at a given output port. Throughout the drawings, like reference numerals are used to indicate like parts. The gain of the array and its back lobe performance are enhanced by placing the dipole radiators over a virtual ground plane. As shown in Figure 1D (Prior Art), between each linear array or row 10 of horizontal dipoles of PSR antenna 100 is a conductive septum 20. The conductive septum 20 comprises only a flat metal plate. These septums, along with the conductive skins 25 of the linear arrays 10 above and below each septum 20, form a waveguide beyond cutoff for the horizontally polarized radiatiors of antenna 100, providing an attenuation of approximately 8 db per inch of depth. By using septums of sufficient depth, radiation to the rear of the arrays is attenuated, and the directivity of the array is enhanced.

Figure 2:
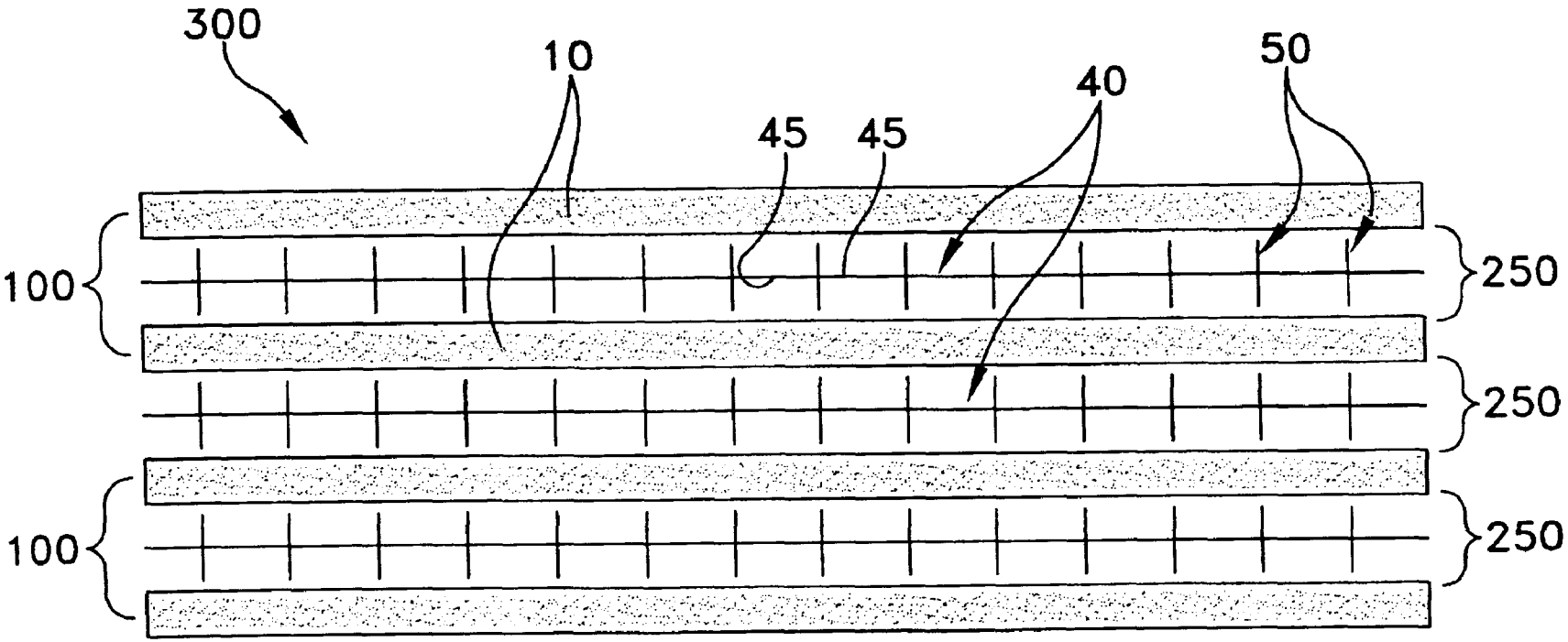
FIG. 2 is a schematic illustration of an integrated antenna system according to an aspect of the present invention.

According to an aspect of the present invention, and as shown in FIG. 2, a thin stripline corporate feed structure 40 using integrated vertically polarized dipoles 50 disposed at predetermined positions along the stripline replaces those septums (or at least a portion thereof). The stripline corporate feed structure 40 includes conductive outer surfaces or skins 45 (upper or lower surfaces) to provide substantially the same waveguide beyond cutoff to the horizontally polarized radiation from the PSR dipoles 10 as the septums they replace. Thus, according to an aspect of the present invention, just as the PSR linear array 10 of horizontal dipoles is coupled via a thick stripline corporate feed having a low density, low dielectric material, a thin, stripline corporate feed 40 having a high density, high dielectric material (thereby enabling the feed to be made much thinner) has a conductive skin 45 on the upper and lower surfaces thereof. The conductive surfaces 45 on the upper and lower surfaces of the thin stripline circuit take the place of the separate flat metal plate (i.e. septum) of prior art systems. In this manner conductive boundaries remain on both sides of the air space 35. A ground plane for the IFF/SSR dipoles 50 is provided via a conductive plate or screen disposed behind the dipoles. This screen or backplate serves the purpose of preventing rear radiation and enhancing forward gain, thus operating as a conductive reflector. The screen may be mechanically coupled to the antennas at a positions behind and across the air gap 35 so as to cover the air gap (FIG. 1D), for example. The stripline corporate feed has the advantage that all lines are in phase and thus it achieves wide bandwidth.

Structural integrity is preserved via the existing structure of the PSR antenna. In this manner the linear arrays of vertical radiators 50 comprising the secondary antenna 250 are interleaved with the existing linear arrays 10 which comprise the primary or PSR antenna 100, thereby providing two antenna functions within a single antenna aperture area 300. Thus, the stripline configuration 40 using the vertical dipoles 50 operates in a dual mode to both provide for operation of the secondary antenna as well as to operate as the "septum" for the primary antenna array. This alleviates the need for a separate antenna on top of the primary antenna array, as required in the current state of the art, thereby reducing space requirements and deployment/transport time.

The IFF/SSR gain and beamwidth is controlled by the spacing and number of dipoles or monopoles within each linear array, as well as by the number of linear arrays used. Azimuth side lobe performance is controlled by the illumination provided by the corporate feed structure. In the case of multiple linear arrays, a second vertically oriented stripline corporate or series feed structure would distribute power to the linear arrays and provide a pencil beam, fan beam or Cosecant squared beam in elevation, for example, as is understood by one skilled in the art.

Figure 3A:
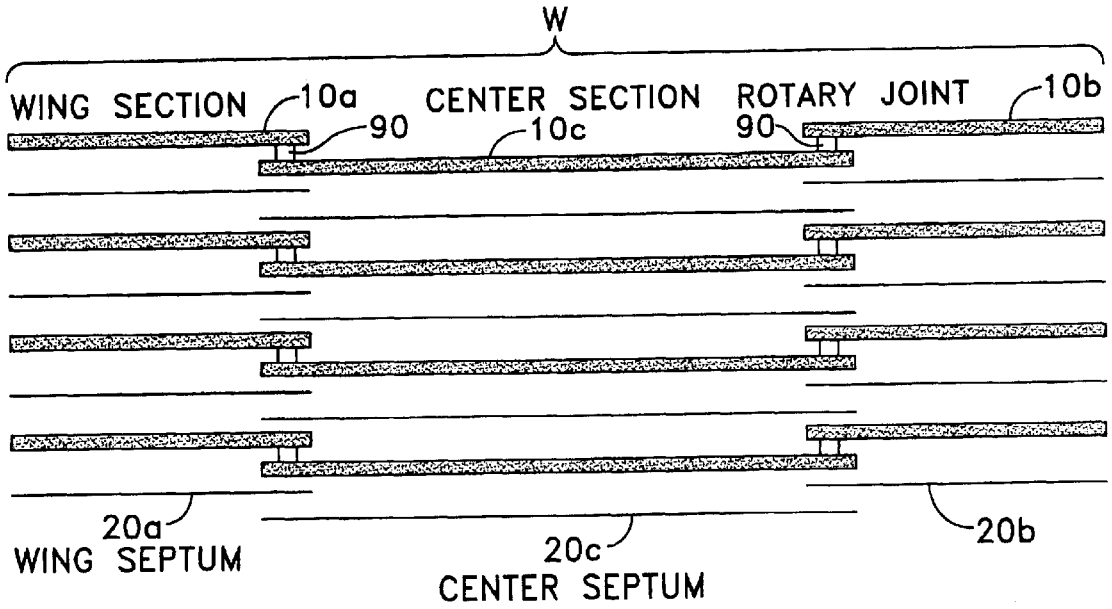
FIG. 3A (PRIOR ART)
FIG. 3A is a schematic illustration of a conventional folded PSR antenna in a deployed or operational configuration.
Figure 3B:
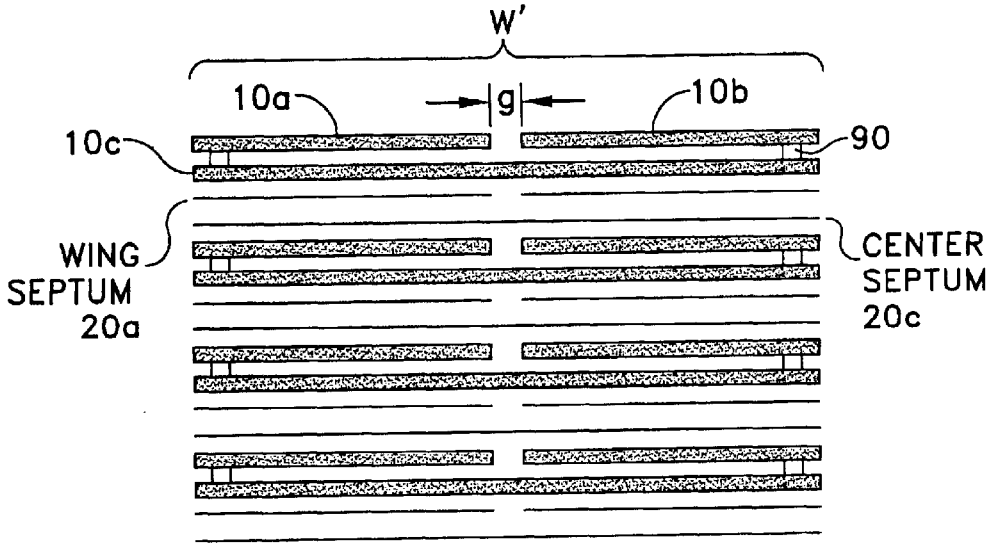
FIG. 3B (PRIOR ART)
FIG. 3B is a schematic illustration of the conventional folded PSR antenna of FIG. 3A in a folded configuration for transport.

According to another aspect of the present invention, integration into folded antenna radar systems such as the AN/TPS-59 and TPS-117 radars, to enable the two antenna/single aperture functionality system discussed above to operate as a foldable/expandable radar system, is accomplished via the following structural modifications. However, before embarking on a detailed discussion, a brief illustration of the operation of a conventional folded PSR antenna radar system such as the AN/TPS-59 PSR antenna is in order. FIG. 3A (Prior Art) provides a schematic illustration of a conventional folded PSR antenna such as the AN/TPS-59 PSR antenna in a deployed or operational configuration. FIG. 3B (Prior Art) schematically depicts the same PSR antenna as shown in FIG. 3A in a folded configuration so as to facilitate transport, for example. For transport configuration, the linear arrays 10 comprising the PSR antenna each comprise three modules or sections. The "wing" sections 10*a,* 10*b* of the linear arrays are vertically offset from the center section 10*c* and connected thereto by two rotary joints 90. The rotary joints 90 operate in conventional fashion to enable the "wing" sections to fold and interleave with the center section to provide an array in transport configuration as shown in FIG. 3B. The wing sections are sized and coupled via the rotary joints in an appropriate manner so that a slight gap g exists between the wing sections in transport mode so as to avoid damage to the array. The septum 20 is similarly segmented in wing sections 20*a,* 20*b* and center section 20*c* and operates in similar manner. For the TPS-59 radar array in transport configuration, the width w (FIG. 3A) is less than 96 inches wide (in contrast to the width w' in deployed mode, which is about 192 inches or 16 feet wide.) In a conventional system, an interleaved configuration of the linear PSR arrays 10 and septums 20 would normally interfere with the vertically polarized dipoles 50 of the IFF/SSR antenna.

Figure 4A:
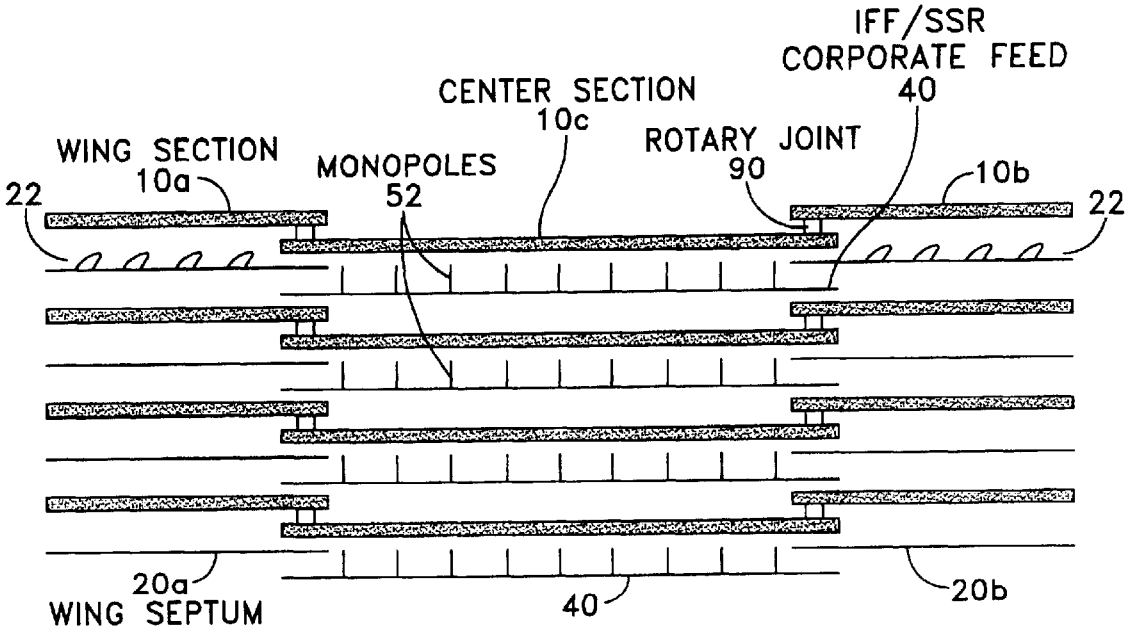
FIG. 4A is a schematic illustration of an integrated antenna system in a deployed or operational configuration according to an aspect of the present invention.
Figure 4B:
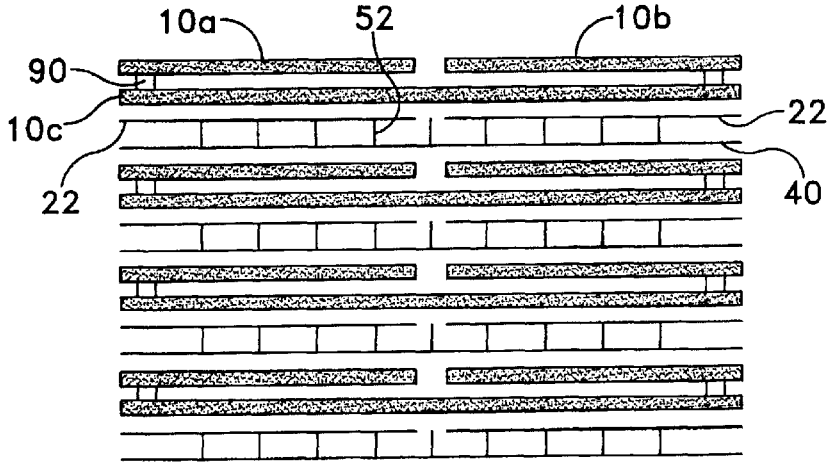
FIG. 4B is a schematic illustration of the antenna system of FIG. 4A in a folded configuration for transport.
Figure 5:
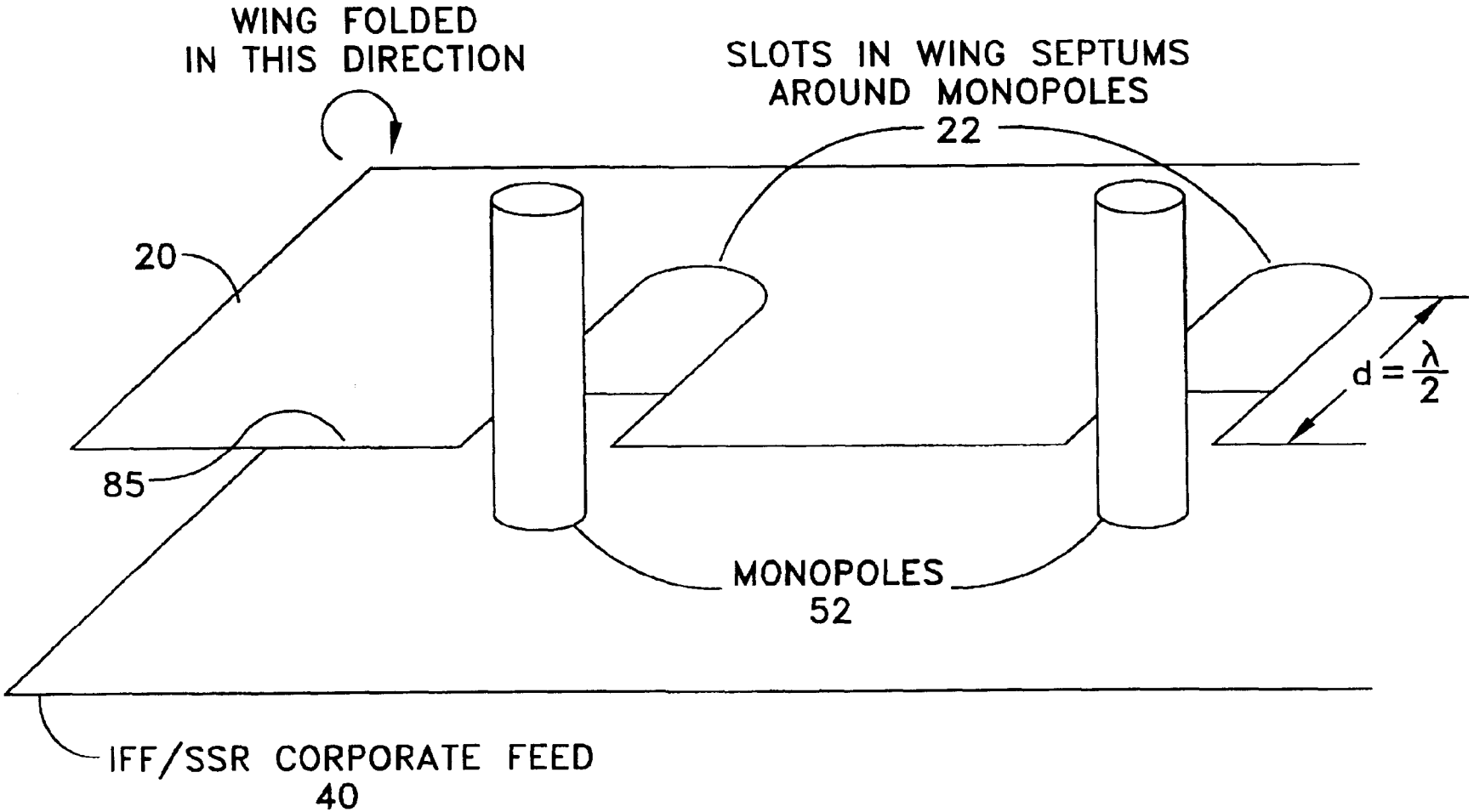
FIG. 5 is a more detailed schematic illustration of the slotted wing septum shown in FIG. 4 to allow folding of the antenna system according to an aspect of the present invention.

According to an aspect of the present invention, for conventional folded radar antenna systems such as that depicted in FIG. 3A and 3B, including the AN/TPS-59 and AN/TPS-117 radar systems, for example, the integrated system of the present invention provides that vertically polarized dipoles 50 (see FIG. 2) of the IFF/SSR antenna array 250 be replaced with vertically polarized monopoles 52 disposed on corporate feed structure 40 interleaved between center sections 10*c* of the linear arrays 10 of antenna 100. The integrated array 300 may include wing section septums 20*a,* 20*b* having a plurality of slots or apertures referred to generally as reference numeral 22 formed at predetermined positions and corresponding to respective positions of each of the monopoles referred to generally as reference numeral 52. The monopoles and slots are aligned in such a manner that when the integrated array 300 is folded, each monopole fits within a respective slot. In this manner, the wing sections 10*a,* 10*b* of the linear array and corresponding septums 20*a,* 20*b* do not interfere with the IFF/SSR monopoles 52. Such a folded, integrated dual antenna system configuration 300 is illustrated in FIG. 4A in a deployed or operational mode. FIG. 4B illustrates the integrated, folded dual antenna system 300 configured in the folded or transport mode. As shown in FIG. 5, if the slots 22 were to be formed or cut approximately one half wavelength in depth d, currents along the leading edge 85 of the wing septums would not be disturbed, and the waveguide beyond cutoff would be preserved without creating radiating discontinuities that would impact the azimuth pattern performance of the PSR antenna. Note that while some reduction in directive gain would result in the use of monopoles in place of dipoles, additional linear arrays in the IFF/SSR antennas would replace directivity.

The above described integrated antenna system provides for realization of simultaneous PSR and IFF/SSR antenna functionality within a single aperture area. In addition, the structure disclosed herein permits the IFF/SSR antenna functionality without the need for a dedicated support structure. Further, the present invention permits integration into existing PSR antenna systems with only minor form factor modifications and without impact on fit or function of existing hardware. Finally, the system according to the present invention provides for a significant decrease in overall system size and weight while providing enhanced mobility and transportability for tactical radar systems.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. An integrated radar antenna system comprising:

a primary radar comprising a plurality of planar arrays of radiating elements; and a secondary radar comprising a plurality of planar arrays of vertical radiators interleaved with said plurality of planar arrays of radiating elements and disposed in a stripline corporate feed structure for receiving signal information associated with said secondary radar, said stripline corporate feed structure operative as a conductive septum for providing a waveguide beyond a cutoff frequency to said radiating elements of said primary radar.

2. The system of claim 1, wherein said primary and secondary radars are operable within a single antenna aperture area.

3. The system of claim 1, wherein said radiating elements of said primary radar comprise horizontally polarized dipoles.

4. The system of claim 1, wherein said radiating elements of said secondary radar comprise vertically polarized dipoles.

5. The system of claim 1, wherein said plurality of planar arrays of radiating elements include a stripline transmission line.

6. The system of claim 1, wherein said integrated system is foldable.

7. In a primary antenna system comprising a plurality of planar arrays of radiating elements, each planar array separated via a conductive septum to form a waveguide beyond a cutoff frequency for said radiating elements, a method of forming an integrated antenna system, said method comprising:

interleaving portions of a secondary antenna between said plurality of planar arrays by replacing at least a portion of each said conductive septum with a stripline corporate feed using vertically polarized dipoles or vertically polarized monopoles defining a secondary antenna.

8. The method of claim 7, wherein portions of said primary and secondary antennas are interleaved so as to be operable within a single antenna aperture area.

9. The method of claim 7, wherein said radiating elements of said primary antenna system comprise horizontally polarized dipoles.

10. The method of claim 7, further comprising forming multiple segments of each said planar array, at least one segment being pivotably coupled to the others to enable folding of said array.

11. The method of claim 10, further comprising forming multiple segments of each said planar array including forming wing portions of said conductive septum, and forming slots within the septum wing portions alignable with a corresponding one of the vertically polarized monopoles.

12. A folded, integrated antenna system for use on a vehicle comprising:

a primary radar comprising a plurality of planar arrays of radiating elements; each planar array comprising a central portion and adjacent wing portions, pivotably coupled to said central portion to fold inward and outward over said central portion; and a secondary radar comprising a plurality of planar arrays of vertical radiators interleaved with said plurality of planar arrays of radiating elements and coupled via a stripline feed structure for receiving signal information, and a conductive wing portion substantially aligned with a corresponding one of said adjacent wing portions of said planar arrays and operatively coupled thereto, said conductive wing portion having a plurality of slots therein, each of said slots aligned with a corresponding one of said vertical radiators of said secondary radar to permit folding of said wing portions of said array and said associated conductive wing portion without interfering with said vertical radiators.

13. In a primary antenna system comprising a plurality of planar arrays of radiating elements, each planar array separated via a conductive septum having a central portion and adjacent wing portions to form a waveguide beyond a cutoff frequency for said radiating elements, a method of forming an integrated antenna system, said method comprising:

interleaving portions of a secondary antenna between said plurality of planar arrays by replacing said central portion of each said conductive septum with a stripline corporate feed using vertically polarized radiators defining a secondary antenna; and forming slots within the septum wing portions alignable with a corresponding one of the vertically polarized radiators.

14. An integrated radar antenna system comprising:

a first plurality of planar arrays of radiating elements; and a second plurality of planar arrays of vertical radiators, each array of said second plurality of planar arrays interleaved between two corresponding planar arrays of said first plurality, each said array of vertical radiators of said second plurality disposed in a stripline corporate feed, said stripline corporate feed operative in a dual mode for receiving signal information associated with said vertical radiators of said second plurality of planar arrays, and for providing a waveguide beyond a cutoff frequency to said radiating elements of said first plurality of planar arrays.

15. The antenna system of claim 14, wherein said stripline corporate feed comprises comprises upper and lower conductive surfaces relative to corresponding planar arrays of said first plurality to provide a virtual ground plane.

* * * * *